US010557326B2

(12) United States Patent
Al-Qasim et al.

(10) Patent No.: US 10,557,326 B2
(45) Date of Patent: Feb. 11, 2020

(54) SYSTEMS AND METHODS FOR STUCK PIPE MITIGATION

(71) Applicant: Saudi Arabian Oil Company, Dhahran (SA)

(72) Inventors: Abdulaziz S. Al-Qasim, Dhahran (SA); Raed A. Alouhali, Dhahran (SA); Sunil Kokal, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 137 days.

(21) Appl. No.: 15/829,446

(22) Filed: Dec. 1, 2017

(65) Prior Publication Data

US 2019/0169950 A1 Jun. 6, 2019

(51) Int. Cl.
*E21B 31/00* (2006.01)
*E21B 17/10* (2006.01)

(52) U.S. Cl.
CPC ..... *E21B 31/00* (2013.01); *E21B 17/1057* (2013.01)

(58) Field of Classification Search
CPC ..... E21B 31/00–06; E21B 10/32–345; E21B 17/1057; E21B 17/10; E21B 10/64; E21B 10/66
See application file for complete search history.

(56) References Cited

U.S. PATENT DOCUMENTS 2,869,644 A 1/1959 Brown
2,973,996 A 3/1961 Self
3,268,003 A 8/1966 Essary
3,364,464 A 1/1968 Delinger
3,939,570 A * 2/1976 Loftus ..... E21B 47/08 33/544.3
4,384,625 A 5/1983 Roper et al.
4,602,690 A 7/1986 Steiger
4,791,998 A 12/1988 Hempkins et al.
5,375,476 A 12/1994 Gray
5,517,024 A 5/1996 Mullins et al.
5,692,563 A 12/1997 Krueger et al.
5,715,898 A 2/1998 Anderson
6,148,917 A 11/2000 Brookey et al.
6,209,667 B1 4/2001 Murray et al.
6,382,333 B1 5/2002 Murray
6,585,043 B1 7/2003 Murray
6,637,524 B2 10/2003 Kruspe et al.
6,942,043 B2 9/2005 Kurkoski
7,036,611 B2 5/2006 Radford et al.
(Continued)

FOREIGN PATENT DOCUMENTS

CN 105134101 A 12/2015

OTHER PUBLICATIONS

The International Search Report and Written Opinion for related PCT application PCT/US2018/063280 dated Mar. 11, 2019.

*Primary Examiner* — George S Gray
(74) *Attorney, Agent, or Firm* — Bracewell LLP; Constance G. Rhebergen; Linda L. Morgan

(57) ABSTRACT

Systems and methods for moving a tubular string within a subterranean well include a ring assembly. The ring assembly includes a structural ring sized with a ring inner diameter to circumscribe the tubular string and a ring outer diameter to fit within a bore of the subterranean well. A rotatable blade extends from the structural ring. Wheels are spaced around an inner diameter surface of the structural ring.

17 Claims, 4 Drawing Sheets

(56) References Cited

U.S. PATENT DOCUMENTS

| | | | | |
|---|---|---|---|---|
| 7,096,961 | B2 | 8/2006 | Clark et al. | |
| 8,333,254 | B2 | 12/2012 | Hall et al. | |
| 8,733,455 | B2 | 5/2014 | Shaikh et al. | |
| 9,097,820 | B2 | 8/2015 | Rasheed | |
| 9,267,331 | B2 | 2/2016 | Radford et al. | |
| 9,284,784 | B2 | 3/2016 | Zaki et al. | |
| 9,528,338 | B2 | 12/2016 | Hall | |
| 2003/0106719 | A1* | 6/2003 | Herrera | E21B 17/1057 175/325.2 |
| 2003/0159834 | A1 | 8/2003 | Kirk et al. | |
| 2004/0007355 | A1 | 1/2004 | Hern et al. | |
| 2015/0047842 | A1 | 2/2015 | Hoskins | |

* cited by examiner

SYSTEMS AND METHODS FOR STUCK PIPE MITIGATION

BACKGROUND OF THE DISCLOSURE

1. Field of the Disclosure

The disclosure relates generally to hydrocarbon development operations in a subterranean well, and more particularly to moving tubular members within a subterranean well during hydrocarbon development operations.

2. Description of the Related Art

A stuck pipe within a subterranean well is a cause of lost time during drilling and completion operations, especially in deviated and horizontal wells. Problems resulting from a stuck pipe can range from incidents causing an increase in costs, to incidents where it takes days to get the pipe unstuck. In extreme cases where the problem cannot be resolved, the bore may have to be plugged and abandoned. In addition, contact between the tubular string and the inner surface of the subterranean well even before the pipe becomes stuck can cause wear and damage to the tubular string.

Wear and damage to the tubular string can also be caused by cutting accumulations in the subterranean well from drilling operations. Such cuttings can accumulate, in particular, at a lower side of a deviated bore. The cuttings can reduce the velocity of fluid flow in the annulus between the tubular string and the inner surface of the subterranean well and can also be a cause of the tubular string sticking and being unable to proceed further into the subterranean well. The tubular string can be, for example, a drill string, a casing string, or another elongated member lowered into the subterranean well.

SUMMARY OF THE DISCLOSURE

Systems and methods of this disclosure provide a ring assembly that can help to prevent a stuck pipe or can help to release a pipe that has been stuck within a subterranean well. Embodiments of this disclosure provide a ring assembly that can be mounted across the tubular string from the surface. The ring assembly is weighted and has the capability of storing and releasing chemicals. An outer surface of the ring assembly can have a rough texture. The ring assembly can have sharp rotating blades, including perforated micro drill bits, that can remove and clear obstructions and cutting accumulations within the bore of the subterranean well.

As disclosed in this disclosure, the ring assembly can deliver the stored chemical to the location where the chemical is needed instead of throughout the entire bore, reducing the total amount of chemicals to be used and protecting the rest of the bore from being exposed to those chemicals. Wheels that are located on an inner diameter of the ring assembly allow the ring assembly to slide along the tubular string and over obstructions resulting from connections between the joints of the tubular string, and other obstructions along the drill string.

The ring assembly can be attached around the tubular string at the surface and lowered into the subterranean well around the tubular string, or can be secured to the tubular string and lowered with the tubular string into the subterranean well.

In an embodiment of this disclosure a system for moving a tubular string within a subterranean well has a ring assembly. The ring assembly includes a structural ring sized with a ring inner diameter to circumscribe the tubular string and a ring outer diameter to fit within a bore of the subterranean well. A rotatable blade extends from the structural ring. Wheels are spaced around an inner diameter surface of the structural ring.

In alternate embodiments, the structural ring can include an internal cavity and a fluid flow path can extend from the internal cavity to an exterior of the ring assembly. A chemical can be stored in the internal cavity. The chemical can be an acid or a lubricant. A wall thickness of the structural ring can be varied around a circumference of the structural ring. An outer diameter surface of the structural ring can include a texture. The structural ring can be a jointed member moveable between an open position and a closed position, where in the open position the structural ring can be operable to be positioned around a joint of the tubular string. The structural ring can include a latching mechanism and the latching mechanism can be operable to connect ends of the jointed member. The ring assembly can further include a motor operable to move the structural ring within the subterranean well.

In an alternate embodiment of this disclosure, a method for moving a tubular string within a subterranean well includes positioning a ring assembly around the tubular string. The ring assembly can include a structural ring sized with a ring inner diameter to circumscribe the tubular string and a ring outer diameter to fit within a bore of the subterranean well. A blade extends from the structural ring. Wheels are spaced around an inner diameter surface of the structural ring. The method further includes rotating the blade to clear a path through the bore around the tubular string.

In alternate embodiments, the structural ring can include an internal cavity and a fluid flow path extending from the internal cavity to an exterior of the ring assembly for delivering fluid stored within the internal cavity to the bore. The fluid stored within the internal cavity can be an acid or a lubricant. A varied wall thickness of the structural ring can be varied around a circumference of the structural ring, where the varied wall thickness causes the structural ring to rotate as the structural ring moves axially within the bore. A rate of rotation of the structural ring can be directly proportional to a rate of axial movement of the structural ring.

In other alternate embodiments, an outer diameter surface of the structural ring can include a texture, and the method can further include grinding an inner diameter surface of the bore with the texture. The structural ring can be a jointed member moveable between an open position and a closed position and the method can further include positioning the structural ring around a joint of the tubular string with the jointed member in the open position. The structural ring can include a latching mechanism and the method can further include connecting ends of the jointed member with the latching mechanism. The ring assembly can further includes a motor and the method can further include moving the structural ring within the subterranean well with the motor.

BRIEF DESCRIPTION OF THE DRAWINGS

So that the manner in which the previously-recited features, aspects and advantages of the embodiments of this disclosure, as well as others that will become apparent, are attained and can be understood in detail, a more particular description of the disclosure briefly summarized previously may be had by reference to the embodiments that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION OF THE DISCLOSURE

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
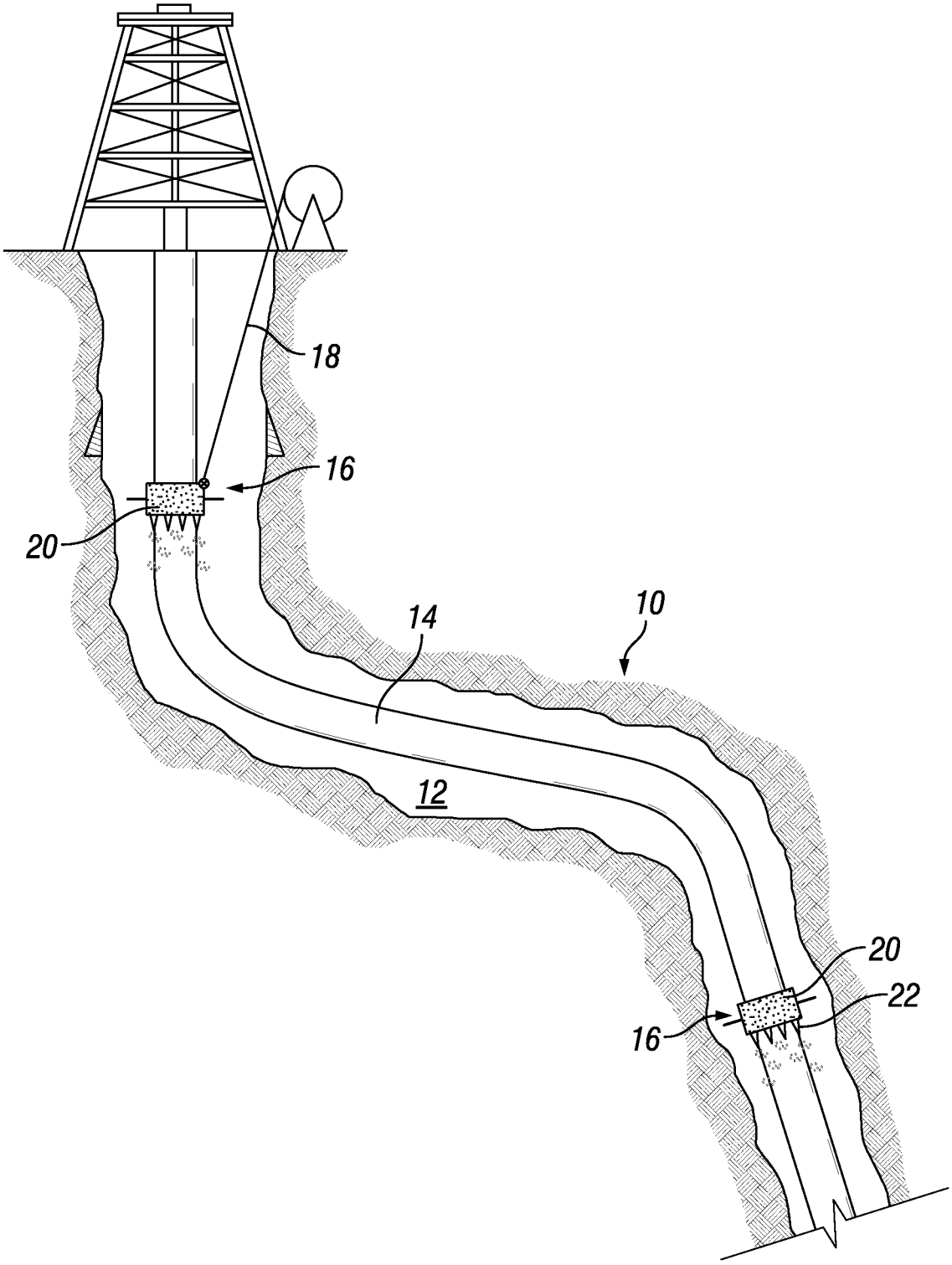
FIG. 1 is a schematic sectional representation of a subterranean well having a ring assembly, in accordance with an embodiment of this disclosure.

Looking at FIG. 1, subterranean well 10 extends downwards from a surface of the earth, which can be a ground level surface or a subsea surface. Bore 12 of subterranean well 10 can extended generally vertically relative to the surface. Bore 12 can alternately include portions that extend generally horizontally or in other directions that deviate from generally vertically from the surface. Subterranean well 10 can be a well associated with hydrocarbon development operations, such as a hydrocarbon production well, an injection well, or a water well.

Tubular string 14 extends into bore 12 of subterranean well 10. Tubular string 14 can be, for example, a drill string, a casing string, or another elongated member lowered into the subterranean well. Although bore 12 is shown as an uncased opening, in embodiments where tubular string 14 is an inner tubular member, bore 12 can be part of an outer tubular member, such as casing.

As tubular string 14 moves through bore 12, there may be times when tubular string 14 is at risk of becoming stuck, or does become stuck. The risk of becoming stuck increases, for example, in bores with an uneven inner surface or bores that have a change in direction. Ring assembly 16 can be used to clear space around tubular string 14 so that tubular string does not get stuck or stay stuck.

In the example of FIG. 1, ring assembly 16 is lowered with control line 18, which can both support ring assembly 16 and be used for communication with ring assembly 16. Ring assembly 16 includes structural ring 20. Structural ring 20 is formed of a heavy material so that the force of gravity causes ring assembly 16 to drop into and fall through bore 12. As an example, structural ring 20 can be formed of tungsten turbid coated with materials that prevent corrosion, or a carbon steel mixed with chrome. The density of structural ring 20 can be higher than the density of tubular string 14.

Ring assembly 16 further includes one or more blades 22. Blade 22 is rotatable in a path that circumscribes tubular string 14 as structural ring 20 rotates. Alternately, blade 22 can rotate about a central axis of blade 22. Blade 22 can alternately rotate both about the central axis of blade 22 and in a path that circumscribes tubular string 14. Blade 22 can be an elongated member with sharp edges. Alternately blade 22 can include a perforated micro drill bit that will remove and clear any obstruction and cutting accumulations in bore 12.

Blade 22 can rotate, for example, by rotation of structural ring 20. Blade 22 can alternately be battery powered and can be activated to start rotating upon impact with material within bore 12, or upon impact with an inner wall of bore 12. The size and number of blades 22 will depend on the dimensions and condition of bore 12, the size of tubular string 14, and the characteristics of the material that is within and surrounding bore 12. As an example, a length of blades 22 can be in a range of 5 inches (in) to one foot (ft).

Figure 2:
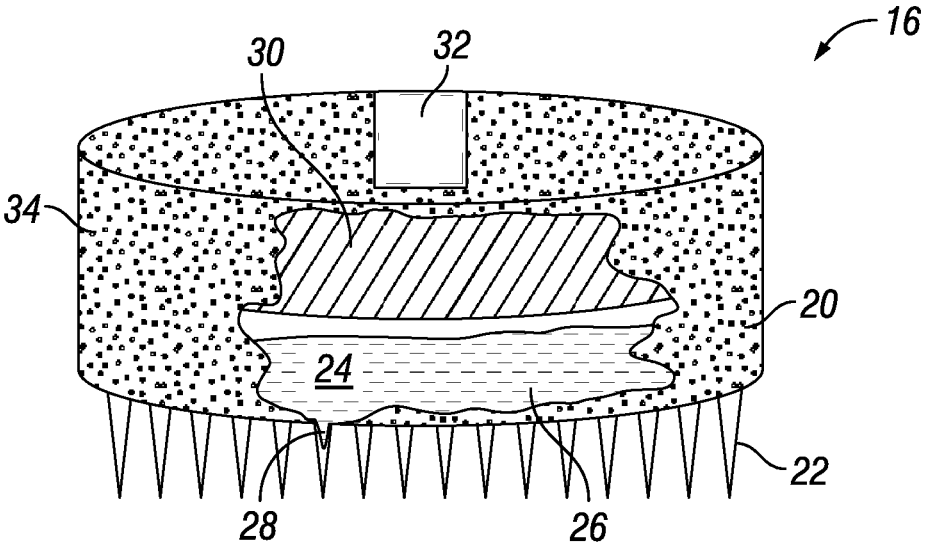
FIG. 2 is a schematic perspective view of a ring assembly, in accordance with an embodiment of this disclosure.

Looking at FIG. 2, a bottom portion of structural ring 20 can have internal cavity 24. A stored chemical 26 can be stored within internal cavity 24. Fluid flow path 28 extends from internal cavity 24 to an exterior of ring assembly 16. Fluid flow path 28 provides a path for the stored chemical 26 within internal cavity 24 to be delivered to bore 12. Fluid flow path 28 can operate to automatically release stored chemicals 26. After initial impact of ring assembly 16 with material within bore 12, or upon impact with an inner wall of bore 12. Fluid flow path 28 can, for example, extend within blade 22 so that when blade 22 begins to rotate, stored chemical 26 is released into bore 12. Stored chemicals 26 will therefore be released locally as released chemicals 27 without exposing the reset of bore 12 to the effects of released chemicals 27, as would be the case if released chemicals 27 were deployed by conventional means, such as circulation through bore 12 from the surface.

Stored chemical 26 can be, for example an acid for treating material within bore 12. An acid can, for example, remove any filter cake stuck to tubular string 14 and to release a stuck pipe. The acid can be, for example a hydrochloric, hydrofluoric acid, or a custom developed chemical for removing filter cake. Alternately, stored chemical 26 can be a lubricant for reducing torque and drag, or reducing friction between tubular string 14 and bore 12 so that moving tubular string 14 within bore 12 is easier. The lubricant can be, for example, an ester based lubricant, or a mineral oil.

A top solid portion 30 of structural ring 20 can be a solid member without any internal hollow or open space. Top solid portion 30 can weight ring assembly 16.

Ring assembly 16 can further include wheels 32. Wheels 32 are spaced around an inner diameter surface of structural ring 20. Wheels 32 can rotate in various directions to allow structural ring 20 to both rotate around tubular string 14 or to move axially along tubular string 14. Wheels 32 can be, for example, conventional or spherical micro rubber wheels with flexible bearings. Wheels 32 can help to center structural ring 30 around tubular string 14 so that structural ring 30 can pass over joint connections and other obstructing members of tubular string 14. Wheels 32 can be formed of a material that can withstand conditions within subterranean well 10, such as temperatures greater than 175 degrees Celsius, abrasive materials such as cuttings and other rock debris, and corrosive fluids such as hydrogen sulfide gas. As an example, wheels 32 can be formed of a plastic material such as polytetrafluoroethylene. Wheels 32 can alternately be formed of a flexible material, such as a rubber, that can be deformed as wheels 32 pass over joint connections or other obstructing members of tubular string 14. Alternately, wheels 32 can be otherwise biased outward and retractable to pass over joint connections or other obstructing members of tubular string 14.

An outer diameter surface of structural ring 20 can include a texture 34. Texture 34 can be used to grind an inner diameter surface of bore 12. Texture 34 can be formed from the same material that forms structural ring 20. Texture 34 can be, for example, a rough surface that is designed to scrape and enlarge tight-holes and ultimately fix a stuck pipe situation. The pattern and depth of texture 34 can be optimized for use in a particular subterranean well 10.

Figure 3:
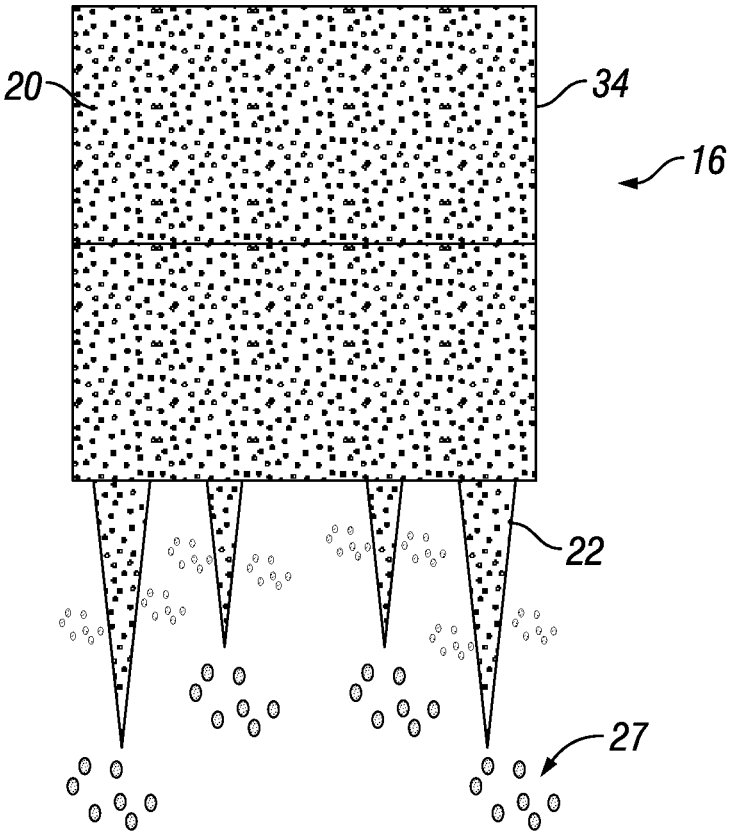
FIG. 3 is a schematic elevation view of a stacked ring assembly, in accordance with an embodiment of this disclosure.

Looking at FIG. 3, ring assembly 16 can be shaped to stack with other ring assemblies 16. In the example embodiment of FIG. 3, two ring assemblies 16 are stacked together. This can be helpful, for example, when retrieving ring assemblies 16. In addition, having multiple ring assemblies 16 together will increase the overall weight of the apparatus and will add more weight on the drill bit to improve drilling performance. More than one ring assembly 16 may be used in bore 12, for example, if more than one stuck pipe situation is encountered as tubular string is moving within bore 12.

Figure 4:
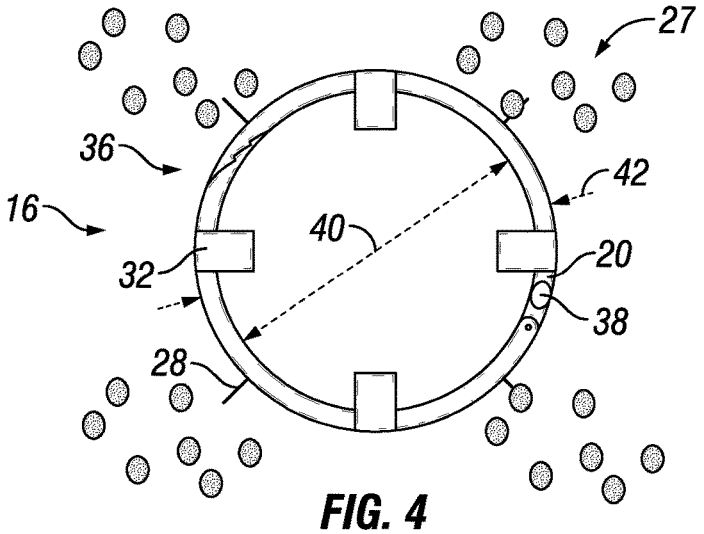
FIG. 4 is schematic plan view of a ring assembly, in accordance with an embodiment of this disclosure, shown with a uniform wall thickness.

Looking at FIG. 4, in order to be secured around tubular string 14 at the surface without having to drop ring assembly 16 over a top end of tubular string 14, structural ring 20 can be a jointed member with latching mechanism 36. Latching mechanism 36 can connect ends of the jointed member. Latching mechanism 36 can be, for example, a ratchet type connection, a pinned connection, a male and female type connection, or other suitable type connection that can connect the ends of the jointed member. The jointed structural ring 20 is moveable between an open position and a closed position. In the open position structural ring 20 is operable to be positioned around a joint of the tubular string 14 across tubular string 14 from the side of tubular string 14.

Ring assembly 16 can be powered by way of control line 18. In alternate embodiments, ring assembly 16 can be powered by other known methods, such as from the mud or other flow through bore 12 or batteries, the systems of which are part of communication and control assembly 38. In embodiments where ring assembly 16 does not rely on control line 18 for power or does not have a control line, communication and control assembly 38 of ring assembly 16 can include a motor operable to move structural ring 20 within the subterranean well.

Ring assembly 16 can be moved within bore 12 by a motor of communication and control assembly 38. Alternately, ring assembly 16 can be secured to the outer diameter of tubular string 14 and carried into bore 12 with tubular string 14. In such an embodiment, ring assembly 16 can have a connection mechanism that secures ring assembly 16 to tubular string 14 and that is releasable to release ring assembly 16 from tubular string 14. This may be particularly useful, for example in deviated wells.

Structural ring 20 can be sized with a minimum ring inner diameter 40 to circumscribe tubular string 14. Minimum ring inner diameter 40 is also sized to pass over joint connections and other obstructing members of tubular string 14. Structural ring 20 has a ring outer diameter 42 sized to fit within bore 12 of subterranean well 10. With such inner and outer dimensions, structural ring can move along tubular string 14 within bore 12.

Figure 5:
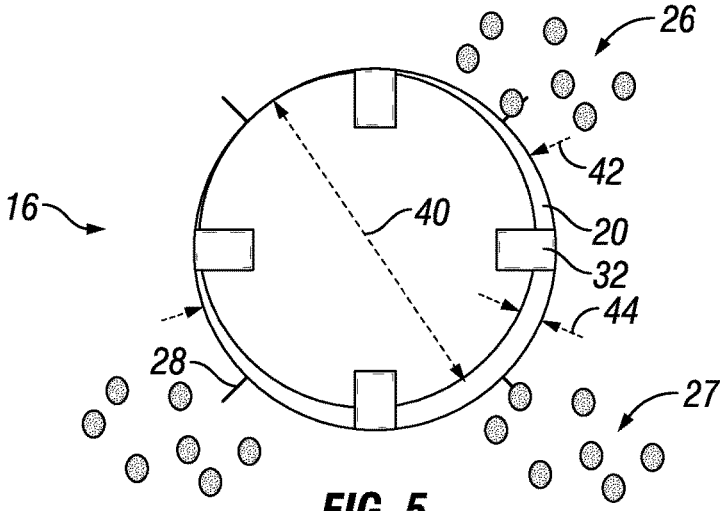
FIG. 5 is schematic plan view of a ring assembly, in accordance with an embodiment of this disclosure, shown with a varied wall thickness.
Figure 6:
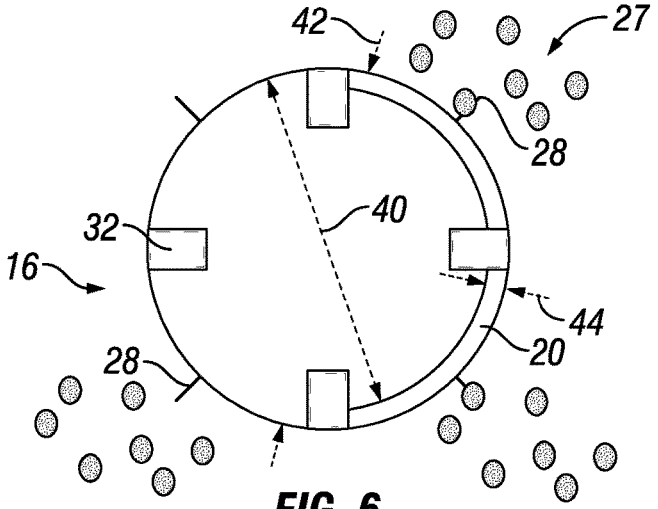
FIG. 6 is schematic plan view of a ring assembly, in accordance with an embodiment of this disclosure, shown with a varied wall thickness.

Looking at FIGS. 5-6, structural ring 20 can have a varied wall thickness 44. The varied wall thickness 44 of structural ring 20 can be varied around a circumference of structural ring 20. In the example of FIG. 5, varied wall thickness 44 has a wall thickness that gradually increases and decreases around the circumference of structural ring 20. In the example of FIG. 6, varied wall thickness 44 includes a first wall thickness that extends around part of the circumference of structural ring 20, and a second different wall thickness that extends around another part of the circumference of structural ring 20.

Varied wall thickness 44 causes a mechanical offset that in turn causes structural ring 20 to rotate as structural ring 20 moves axially within bore 12. The rate of rotation of structural ring 20 can be directly proportional to the rate of axial movement of structural ring 20. That is, the faster that structural ring moves axially along structural ring 20, the faster the rotation of structural ring 20.

Figure 7:
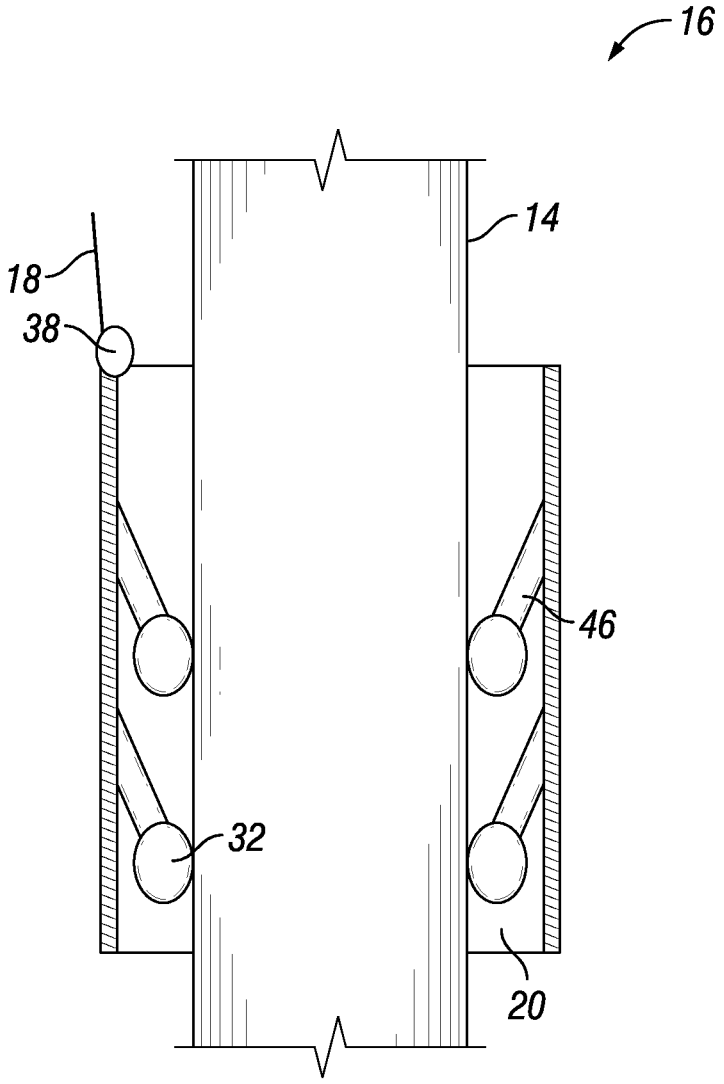
FIG. 7 is a schematic section view of a ring assembly surrounding a tubular string, in accordance with an embodiment of this disclosure.

Looking at FIG. 7, in an example embodiment wheels 32 are biased radially outward by arms 46. Arm 46 is secured at a first end to an inner diameter of structural ring 20 in a manner that allows arm 46 to rotate relative to structural ring 20. Arm 46 is secured at a second end to a wheel 32.

In an example of operation, systems and methods utilize ring assembly 16, as needed, for preventing a stuck pipe or unsticking an already stuck pipe. When ring assembly 16 includes a jointed structural ring 30, such as shown in FIG. 4, ring assembly 16 can be positioned around tubular string 14 at the surface at any time. Control line 18 can manage the descent of ring assembly 16 into bore 12 and maintain the position of ring assembly 16 at the target region of bore 12.

In alternate embodiments, ring assembly 16 can be secured to tubular string 14, such as integrated with the bottom assembly, and lowered with tubular string 14 into bore 12. Ring assembly 16 can then be detached from tubular string at a desired location within bore 12. In yet another alternate embodiment, ring assembly 16 can be moved within bore 12 by a motor of communication and control assembly 38.

Wheels 32 of ring assembly 16 can allow structural ring 20 to both rotate around tubular string 14 or to move axially along tubular string 14 and can permit structural ring 20 to pass over joint connections and other obstructing members of tubular string 14. As ring assembly 16 moves axially along tubular string 14, ring assembly 16 can rotate. Rough texture 34 can scrape and enlarge an inner diameter surface of bore 12. When ring assembly 16 impacts material within bore 12 or an inner wall of bore 12, blades 22 can rotate to break up the blockage and stored chemicals 26 can be released from internal cavity 24 into bore 12. Ring assembly 16 can be retrieved by control line 18, a slickline, a motor of communication and control assembly 38, or any combination of the control line 18, the slickline, or the motor of communication and control assembly 38.

Embodiments of this disclosure can therefore clear obstructions in bore 12 to mitigate potential and actual stuck pipe problems, and can clear cutting accumulations for improved circulation within subterranean well 10. The ring assembly 16 can additionally add weight on the drill bit for improved drilling performance. The systems and methods of this disclosure can reduce the time and costs associated with stuck pipes compared to currently available remedial actions and interventions.

Embodiments of the disclosure described, therefore, are well adapted to carry out the objects and attain the ends and advantages mentioned, as well as others that are inherent. While example embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for moving a tubular string within a subterranean well, the system having:

a ring assembly including:

a structural ring sized with a ring inner diameter to circumscribe the tubular string and a ring outer diameter to fit within a bore of the subterranean well, where the structural ring includes an internal cavity and a fluid flow path extending from the internal cavity to an exterior of the ring assembly;

a rotatable blade extending from the structural ring, the blade rotatable in a path that circumscribes the tubular string; and wheels spaced around an inner diameter surface of the structural ring.

2. The system of claim 1, further including a chemical stored in the internal cavity.

3. The system of claim 2, where the chemical is an acid.

4. The system of claim 2, where the chemical is a lubricant.

5. The system of claim 1, where an outer diameter surface of the structural ring includes a texture.

6. The system of claim 1, where the structural ring is a jointed member moveable between an open position and a closed position, where in the open position the structural ring is operable to be positioned around a joint of the tubular string.

7. The system of claim 6, where the structural ring includes a connector, the connector operable to connect ends of the jointed member, where the connector is selected from a group consisting of a ratchet type connector, a pinned connector, and a male and female type connector.

8. A method for moving a tubular string within a subterranean well, the method including:

positioning a ring assembly around the tubular string, the ring assembly including:

a structural ring sized with a ring inner diameter to circumscribe the tubular string and a ring outer diameter to fit within a bore of the subterranean well, where the structural ring includes an internal cavity and a fluid flow path extending from the internal cavity to an exterior of the ring assembly for delivering fluid stored within the internal cavity to the bore;

a blade extending from the structural ring, the blade rotatable in a path that circumscribes the tubular string; and wheels spaced around an inner diameter surface of the structural ring; and rotating the blade to clear a path through the bore around the tubular string.

9. The method of claim 8, where the fluid stored within the internal cavity is an acid.

10. The method of claim 8, where the fluid stored within the internal cavity is a lubricant.

11. The method of claim 8, where an outer diameter surface of the structural ring includes a texture, and the method further includes grinding an inner diameter surface of the bore with the texture.

12. The method of claim 8, where the structural ring is a jointed member moveable between an open position and a closed position and the method further includes positioning the structural ring around a joint of the tubular string with the jointed member in the open position.

13. The method of claim 12, where the structural ring includes a connector and the method further includes connecting ends of the jointed member with the connector, where the connector is selected from a group consisting of a ratchet type connector, a pinned connector, and a male and female type connector.

14. A system for moving a tubular string within a subterranean well, the system having:

a ring assembly including:

a structural ring sized with a ring inner diameter to circumscribe the tubular string and a ring outer diameter to fit within a bore of the subterranean well, where an outer diameter surface of the structural ring includes a texture;

a rotatable blade extending from the structural ring, the blade rotatable in a path that circumscribes the tubular string; and wheels spaced around an inner diameter surface of the structural ring.

15. The system of claim 14, where the structural ring includes an internal cavity and a fluid flow path extending from the internal cavity to an exterior of the ring assembly.

16. A method for moving a tubular string within a subterranean well, the method including:

positioning a ring assembly around the tubular string, the ring assembly including:

a structural ring sized with a ring inner diameter to circumscribe the tubular string and a ring outer diameter to fit within a bore of the subterranean well;

a blade extending from the structural ring, the blade rotatable in a path that circumscribes the tubular string; and wheels spaced around an inner diameter surface of the structural ring; and rotating the blade to clear a path through the bore around the tubular string; where an outer diameter surface of the structural ring includes a texture, and the method further includes grinding an inner diameter surface of the bore with the texture.

17. The method of claim 16, where the structural ring includes an internal cavity and a fluid flow path extending from the internal cavity to an exterior of the ring assembly for delivering fluid stored within the internal cavity to the bore.

* * * * *